US005394223A

United States Patent [19]

Hart et al.

[11] Patent Number: 5,394,223

[45] Date of Patent: Feb. 28, 1995

[54] APPARATUS FOR IMAGE REGISTRATION

[75] Inventors: Steven C. Hart, Webster; Fred F. Hubble, III, Rochester; Thomas J. Hammond, Penfield; Jeffrey J. Folkins; James P. Martin, both of Rochester, all of N.Y.

[73] Assignee: Xerox Corporation, Stamford, Conn.

[21] Appl. No.: 930,642

[22] Filed: Aug. 17, 1992

[51] Int. Cl.[6] ..... G03G 5/00

[52] U.S. Cl. ..... 355/212; 347/116; 355/207; 355/208; 355/326 R

[58] Field of Search ..... 355/317, 212, 208, 326 R, 355/207, 327; 346/160, 157

[56] References Cited

U.S. PATENT DOCUMENTS

| | | | |
|---|---|---|---|
| Re. 32,967 | 6/1989 | St. John et al. | 242/57.1 |
| 4,135,664 | 1/1979 | Resh | 235/475 |
| 4,556,311 | 12/1985 | Tagoku | 355/212 |
| 4,569,584 | 2/1986 | St. John et al. | 355/317 X |
| 4,740,802 | 4/1988 | Stuckey-Kauffman et al. | 346/157 |
| 4,912,491 | 3/1990 | Hoshino et al. | 346/160 |
| 4,961,089 | 10/1990 | Jamzadeh | 355/207 |
| 4,963,899 | 10/1990 | Resch, III | 346/157 |
| 5,040,003 | 8/1991 | Willis | 355/326 R X |
| 5,175,570 | 12/1992 | Haneda et al. | 346/160 |
| 5,208,633 | 5/1993 | Genovese | 355/212 |
| 5,260,725 | 11/1993 | Hammond | 346/157 |

OTHER PUBLICATIONS 55-98016, Motonosuke Honda, "Device for Correcting Zigzag Movement of Belt", Jul., 1980, pp. 93-98.

DD 239,390, FEB Zementanlagenbau Dessau, "Device for Indicating the Off-Center Running of Conveyor Belts", Jul. 15, 1985.

*Primary Examiner*—A. T. Grimley
*Assistant Examiner*—Shuk Y. Lee
*Attorney, Agent, or Firm*—Lloyd F. Bean, II

[57] ABSTRACT

An apparatus for positional tracking a moving photoconductive belt and adjusting an imager in an electrophotographic printing machine to correct for alignment errors when forming a composite image. Registration errors are sensed by developing an appropriate set of target marks, detecting the target marks, and controlling the position of the imager.

7 Claims, 4 Drawing Sheets

APPARATUS FOR IMAGE REGISTRATION

This invention relates generally to an apparatus and method for positional tracking a moving photoconductive belt, and more particularly concerns aligning an imager in an electrophotographic printing machine to permit superposing registered latent images to be exposed on the belt so that the images are aligned in the process and lateral directions, and skew position.

In single pass electrophotographic printers having more than one process station which provide sequential images to form a composite image, critical control of the registration of each of the sequenced images is required. This is also true in multiple pass color printers, which produce sequential developed images superimposed on to form a multi-color image. Failure to achieve registration of the images yields printed copies in which the images are misaligned. This condition is generally obvious upon viewing of the copy, as such copies usually exhibit fuzzy color separations, bleeding and/or other errors which make such copies unsuitable for intended uses.

A simple, relatively inexpensive, and accurate approach to register latent images superposed in such printing systems has been a goal in the design, manufacture and use of electrophotographic printers. This need has been particularly recognized in the color and highlight color portion of electrophotography. The need to provide accurate and inexpensive registration has become more acute, as the demand for high quality, relatively inexpensive color images has increased.

Various techniques for registering images on belts have hereinbefore been devised as illustrated by the following disclosures, which may be relevant to certain aspects of the present invention:

U.S. Pat. No. 4,912,491 Patentee: Hoshino et al. Issued: Mar. 27, 1990

U.S. Pat. No. Re. 32,967 Patentee: St. John et al. Issued: Jun. 27, 1989

Japanese Patent No. 55-98016 Patentee: Honda Issued: Jul. 25, 1980

U.S. Pat. No. 4,135,664 Patentee: Resh Issued: Jan. 23, 1979

U.S. Pat. No. 4,963,899 Patentee: Resch, III Issued: Oct. 16, 1990

GDR-A-239,390 Patentee: Schmeer et al. Issued: Sep. 24, 1986

U.S. Pat. No. 4,569,584 Patentee: St. John et al. Issued: Feb. 11, 1986

U.S. Pat. No. 4,961,089 Patentee: Jamzadeh Issued: Oct. 2, 1990

The disclosures of these references are briefly summarized as follows:

U.S. Pat. No. 4,912,491 discloses an apparatus for forming superimposed images and registration marks corresponding to the position of the images associated therewith. The registration marks are formed apart from the imaging portion of the medium in a transparent area to be illuminated from the backside. Detectors sense the position of the registration marks as the marks pass between the illuminated areas. The sensing of the registration marks is used in determining proper registration positioning, whereby the image forming devices may be adjusted to achieve such registration.

U.S. Pat. No. Re. 32,967 discloses a web tracking system for a continuous web which passes along a predetermined path through one or more processing stations. The tracking system has aligned tracking indicia on one or both sides of the web and detectors sensing these indicia which are indicative of dimensional changes in width and length of the web at a particular point. An edge sensor is also provided to determine movement of the web.

Japanese Patent No. 55-981016 discloses compensating for errors in the process direction of movement of the belt by rotation of shafts which engage the tension and drive rollers of the belt. Upon detection of movement of the belt in a non-linear fashion (e.g., the edge exhibiting a zigzag effect), pressure is applied on these shafts to tension the belt through rollers to urge the belt to turn and maintain its desired orientation.

U.S. Pat. No. 4,135,664 control, lateral registration in printers. A cylinder drum print is marked at a first print station with ink of a first color. The marks are scanned and a positional count is summed until the marks of a record station are detected. By detection and averaging of the time differential between the lateral registration marks, lateral errors can be determined and corrected by physically shifting the lateral position of the print cylinder.

U.S. Pat. No. 4,963,899 discloses an electrostatographic printing and copying device employing a registration system which senses discharge line patterns to provide both in-track and cross-track signal information permitting synchronous processing to provide accurate multi-color image reproduction.

GDR-A-239,390 discloses a device having a first and second set of proximity sensors which operator to signal a first off-center condition. If the permissible lateral off-center condition is exceeded, a second proximity sensor shuts down the device.

U.S. Pat. No. 4,569,584 discloses a color electrographic recording apparatus having a single imaging station through which the recording medium is passed in a first and second direction. After each latent image is formed, it is developed and the medium is returned to superpose another image thereon. Aligned tracking lines and registration lines are sensed to permit corrections of lateral and process direction errors.

U.S. Pat. No. 4,961,089 discloses an electrostatic reproduction apparatus having a web tracking system wherein the web rotates on rollers through image processing stations. A guide is provided to move the web around the rollers. The guide includes a steering roller which is actuated by a web tracking system.

In accordance with one aspect of the present invention, there is provided a printing device for providing color prints of the type having a semi-transparent imageable surface adapted to move along a preselected path. The printing device also has at least one image processing station for forming a composite image on the imageable surface; means for marking indicia on the imageable surface; means for sensing the indicia to detect registration deviations from the preselected path of movement of the imageable surface; and means, responsive to the sensing means, for adjusting the image processing station to compensate for the detected registration deviations, thereby enhancing the registration of the composite image on the imageable surface.

Pursuant to another aspect of the present invention, there is provided an electrophotographic printer of the type having a semi-transparent photoconductive imageable surface mounted for movement substantially in a predetermined reference direction. The electrophotographic printer also has an imager for sequentially, selectively exposing portions of the imageable surface to form a composite image; developer means for marking a target on the imageable surface; means for sensing the target on the imageable surface; and means, responsive to the sensing means, for adjusting the imager to compensate for the detected registration deviations, thereby enhancing registration of the composite image on the imageable surface.

Pursuant to another aspect of the present invention, there is provided a method of compensating for photoconductive belt deviations from a preselected path of movement, having the steps of marking indicia on the photoconductive belt; sensing the indicia on the photoconductive belt to detect registration deviations from the preselected path of movement; and adjusting an image processing station adapted to record latent images on the photoconductive belt, in response to the sensing step, to compensate for the detected registration deviations.

Other features of the present invention will become apparent as the following description proceeds and upon reference to the drawings, in which:

FIG. 1*a* and 1*b* is a top and a side view of an imaging station for carrying out and taking advantage of the various aspects of the present invention and;

While the present invention will be described in connection with a preferred embodiment thereof, it will be understood that it is not intended to limit the invention to that embodiment. On the contrary, it is is intended to cover all alternatives, modifications and equivalents that may be included within the spirit and scope of the invention as defined by the appended claims.

DETAILED DESCRIPTION OF THE INVENTION

Figure 4:
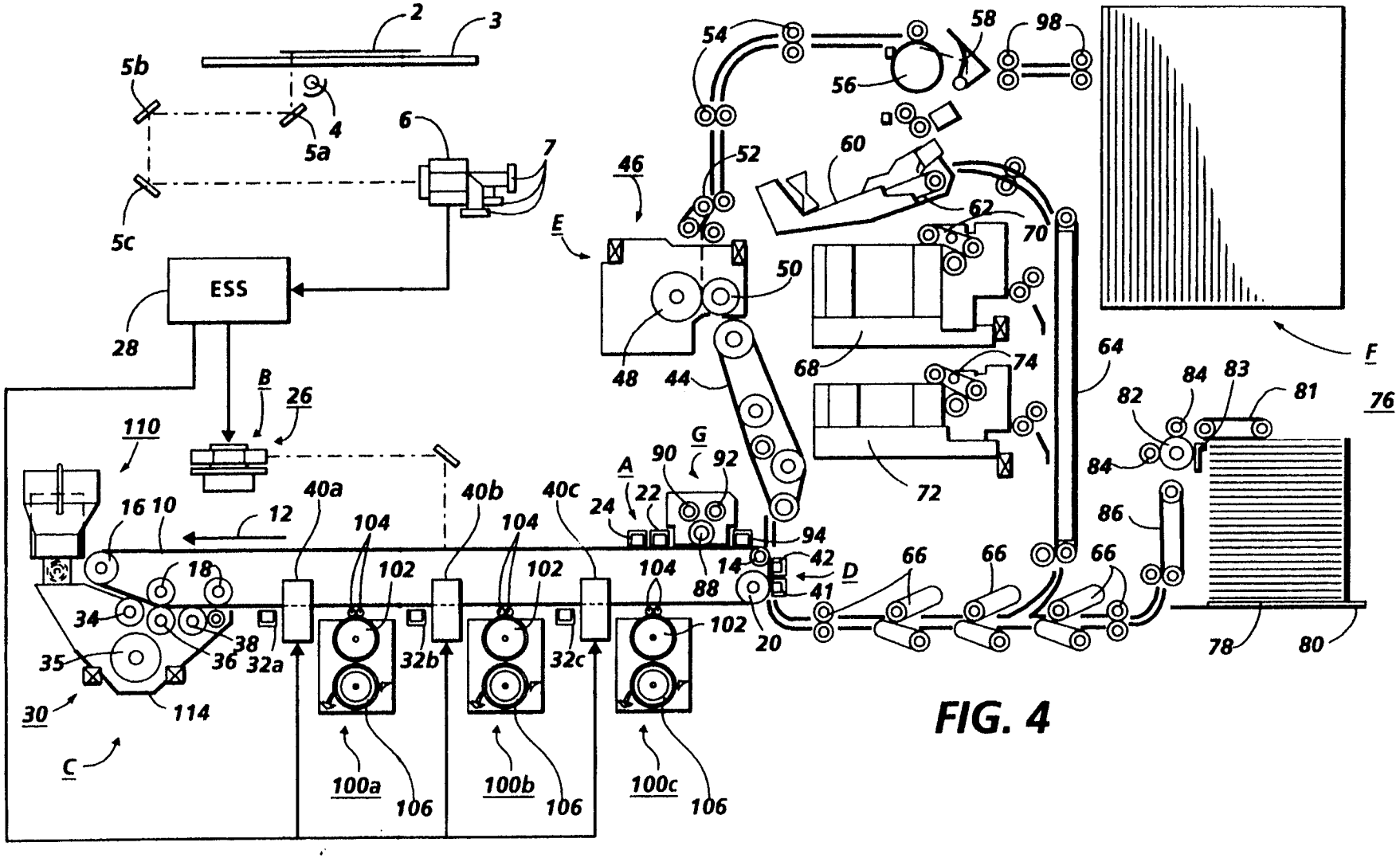
FIG. 4 is a schematic elevational view depicting an illustrative electrophotographic printing machine incorporating the features of the present invention therein.

For a general understanding of the features of the present invention, reference numerals have been used throughout to designate identical elements. FIG. 4 schematically depicts the various elements of an illustrative color electrophotographic printing machine incorporating the method of the present invention therein. It will become evident from the following discussion that this method is equally well suited for use in a wide variety of printing machines and is not necessarily limited in its application to the particular embodiments depicted herein.

Inasmuch as the art of electrophotographic printing is well know, the various processing stations employed in the FIG. 4 printing machine will be shown hereinafter schematically and their operation described briefly with reference thereto.

With reference to FIG. 4, the color copy process typically involves a computer generated color image which may be inputted into image processor unit (not shown), or alternately a color document 2 to be copied may be placed on the surface of a transparent platen 3. A scanning assembly having of a halogen or tungsten lamp 4 is used as a light source to illuminate the color document 2. The light reflected from the color document 2 is reflected by mirrors 5*a*, 5*b* and 5*c*, through lenses (not shown) and a dichroic prism 6 to three charged-coupled devices (CCDs) 7 where the information is read. The reflected light is separated into the three primary colors by the dichroic prism 6 and the CCDs 7. Each CCD 7 outputs an analog voltage which is proportional to the strength of the incident light. The analog signal from each CCD 7 is converted into an 8-bit digital signal for each pixel (picture element) by an analog/digital converter. The digital signal enters an image processor unit. The output voltage from each pixel of the CCD 7 is stored as a digital signal in the image processing unit. The digital signal which represent the blue, green, and red density signals is converted in the image processing unit into four bitmaps: yellow (Y), cyan (C), magenta (M), and black (Bk). The bitmap represents the exposure value for each pixel, the color components as well as the color separation.

The electrophotographic printing machine employs a semi-transparent photoconductive belt 10. Preferably, photoconductive belt 10 is made from a photoconductive material coated on a ground layer, which, in turn, is coated on anti-curl backing layer. The photoconductive material is made from a transport layer coated on a generator layer. The transport layer transports positive charges from the generator layer. The interface layer is coated on the ground layer. The transport layer contains small molecules of di-m-tolydiphenydiphenylbithenyldiamine dispersed in a polycarbonate. The generation layer is made from trigonal selenium. The grounding layer is made from a titanium coated mylar. The ground layer is very thin and allows a portion of the incident light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24, charge photoconductive belt 10 to a relatively high, substantially uniform potential. Corona generating device 22 places all the required charge on photoconductive belt 10. Corona generating device 24 acts as leveling device, and fills in any areas missed by corona generating device 22.

Next, the charged portion of the photoconductive surface is advanced through imaging station B. At imaging station B, the uniformly charged photoconductive surface is exposed by an imager, such as a laser based output scanning device 26, which causes the charged portion of the photoconductive surface to be discharged in accordance with the output from the scanning device. The scanning device is a laser raster output scanner (ROS). The ROS performs the function of creating the output image copy on the photoconductive surface. It creates the image in a series of horizontal scan lines with each line having a certain number of pixels per inch. The ROS may include a laser with rotating polygon mirror blocks and a suitable modulator or, in lieu thereof, a light emitting diode array (LED) as a write bar. An electronic subsystem (ESS) 28 is the control electronics which prepare and manage the image data flow between the imaging processing unit and the ROS. It may also include a display, user interface, and electronic storage, i.e. memory, functions. The ESS is actually a self-contained, dedicated mini computer. The photoconductive surface, which is initially charged to a high charge potential, is selectively discharged by the ROS recording a charged pattern corresponding to the information desired to be printed on the photoconductive surface. In addition to this charge pattern, the ROS writes target marks or indicia on photoconductive belt 10. Preferably, the target marks are proceeding and/or adjacent to the frame of the image charge pattern.

At development station C, a magnetic brush development system, indicated generally by the reference numeral 30 advances developer material into contact with the electrostatic latent image. The development system typically comprises a plurality of three magnetic brush developer rollers, indicated generally by the reference numerals 34, 36 and 38. A paddle wheel 35 picks up developer material from developer sump 114 and delivers it to the developer rollers. When developer material reaches rolls 34 and 36, it is magnetically split between the rolls with half of the developer material being delivered to each roll. Photoconductive belt 10 is partially wrapped about rolls 34 and 36 to form extended development zones. A magnetic roller, positioned after developer roll 38, in the direction of arrow 12, is a carrier granular removal device adapted to remove any carrier granules adhering to belt 10. Thus, rolls 34, 36, and 38 advance developer material into contact with the electrostatic latent image and the latent target marks. The latent image and the latent target marks attract toner particles from the carrier granules of the developer material to form a developed toner powder image on the photoconductive surface of belt 10. Toner dispenser 110 dispenses unused toner particles into sump 114. Each of the foregoing developer rollers include a rotating sleeve having a stationary magnetic disposed interiorly thereof. The magnetic field generated by the magnet attracts developer material from paddle wheel 35 to the sleeve of the developer roller. As the sleeve rotates, it advances the developer material into the development zone where toner particles are attracted from the carrier granules to the charged area latent image and the latent target marks. In this way, the charged area latent image and the latent target marks are developed with toner. The toner particles being employed in developer unit 30 are black. The black developed latent image and developed latent target marks continues to advance with photoconductive belt 10 in the direction of arrow 12.

Figure 1A:
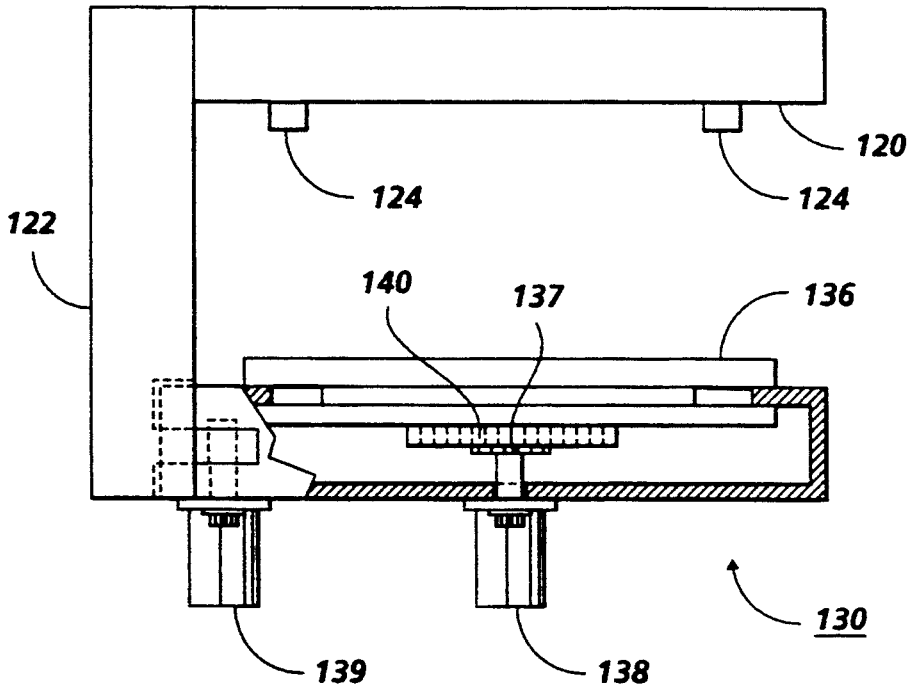
Figure 1B:
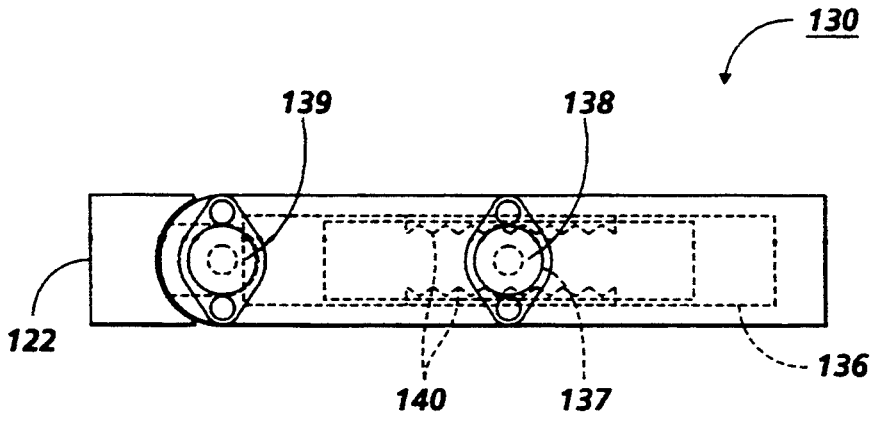

Corona generator **32*a* recharges the photoconductive surface of belt 10. A second imaging station 40*a*, which is representative of imaging stations 40*b* and 40*c*, is shown in greater detail in FIGS. 1*a* and 1*b*. Now turning to FIGS. 1*a* and 1*b*, the second imaging station 40*a* includes a LED image array bar 136, or may for example include gas discharge image bar, LCD shutter image bar or another ROS. The imaging station 40*a* is used to measure the registration of the photoconductive belt, and to superimpose a subsequent image by selectively discharging the recharged photoconductive surface. Specifically, imaging stations 40*a*, 40*b* and 40*c* have an inner housing 120 which is mounted on support frame 122 and contains a sensor unit 124. An outer housing 130 has the image bar 136 secured therein facing the senor unit 124 in the inner housing. The sensor unit 124 is light sensitive device, such as a PIN type photodiode or photomultiplier tube. The sensor unit 124 is sensitive to the wavelength used by its corresponding imager. No optics or focusing is necessary for the sensor unit, however, it is preferred to use a focusing lens (not shown) to enable a higher signal to noise ratio with any given sensor unit by allowing the sensor unit to measure more of the imager pixels. The photoconductive belt 10 is disposed between the inner housing 120 and the outer housing 130. The spacing between the imager 136 and the sensor unit 124 is equal to the nominal focal length between the imager and the photoconductive belt 10, plus the small distance the sensor unit is placed behind the photoconductive belt 10, (typically 1 through 5 mm). The image bar 136 is mounted on the outer housing by a slide mount arrangement 137 which allows translation of the image bar in a plane substantially parallel to the belt. Further, the outer housing 130** is pivotally connected to permit angular translation in the place of the belt.

Stepper motor 138 is mounted on the outer housing 130 in a suitable fashion. Actuation of the stepper motor 138 selectively translates the image bar 136 in a forward and reverse manner in the slide mount 137. Thus, actuation of the stepper motor 138 drives the image bar 136 in a linear fashion with respect to the inner housing 120 and belt 10. It will be appreciated that stops (not shown) may be provided in the outer housing to limit the travel of the image bar 136 relative to the inner housing 120. Stepper motor 139 is mounted on frame 122 and actuation of the stepper motor 139 causes the outer housing 130 to rotate and, consequently, image array bar 136 rotates. In this embodiment, stepper motors 138 and 139 have relatively small incremental step actuations utilizing gear reduction units (not shown) incremented approximately in 0.001 mm divisions which is a fraction of a pixel width. Image bars 136 can be linearly actuated and, further, can be rotational actuated to change the orientation of image bars 136 at each of the imaging stations **40*a*, 40*b* and 40*c* relative to the photoconductive belt 10. The stepper motors 138 and 139 in each of the imaging stations 40*a*, 40*b* and 40*c*, are actuated by control signals from the ESS 28. Further, other means can be used to translate and rotate image bars 136**. Included could be electronic means whereby the translation can be accomplished by shifting pixels and or image lateral timing in combination with the electronic means for rotating imager output.

In the instance, misregistration of the superposed images in the process direction will be avoided when the video image signal output from ESS 28 to each of the imaging station is appropriately timed to compensate for the belt travel between stations. That is, for example, registration in the process direction begins when the second imager station **40*a* scans for the presence of a target mark which was exposed and developed by the first imager 26 and developer unit 30. The arrival of the target marks at the second imaging station 40*a*, and subsequent imaging stations are detected by turning the imager on to a level such that the light can be detected by sensor unit 124 through the semi-transparent photoconductive surface of belt 10 for a window of time when the timing mark is expected. In some situations where the imager exposure intensity is varied by varying the image on time, it is preferred to turn the image light on for the entire pixel cycle so as to provide a uniform temporal signal to sensor 124. In the present embodiment, the light level used is the same light used to expose the charged belt 10 which is approximately 5 ergs/cm$^2$. However, it should be apparent to one skilled in the art that the level would depend on the transmittance of photoconductive belt and the sensitivity of sensor unit 124. The measurement by the sensor unit 124 of the occlusion of the light from the second imaging station 40***a* provides the timing signal. Additionally, the process direction registration sensing signals could be used to trigger the second (and subsequent) image bars at the appropriate time to achieve line by line registration in the process direction independent of the photoconductive belt 10 speed variation and system mechanical tolerances.

Since, the light level from a single pixel of the imager may be fairly low there is a signal to noise ratio problem with detecting the occlusion of a single pixel of the imager, therefore it is preferred to turn on multiple imager pixels to improve the signal to noise ratio, thus enhancing the detection of the target. The number of pixels which can be turned on is dependent on the physical width of the sensor unit 124. For example, the sensor active area width might be 3 mm and be able to measure approximately 47 pixels from a 400 spot per inch imager.

Also, due to intensity differences in the output of the image bars between setup cycles caused by variations in the electrographic printing machine, it is preferred to monitor the intensity of the image bar 136 output with the sensor unit 124. The output signal from the sensor unit 124 is sent to the electronic subsystem (ESS) 28 and a feedback signal from the electronic subsystem (ESS) 28 is sent to the imaging station to compensate for any intensity variations.

Figure 2:
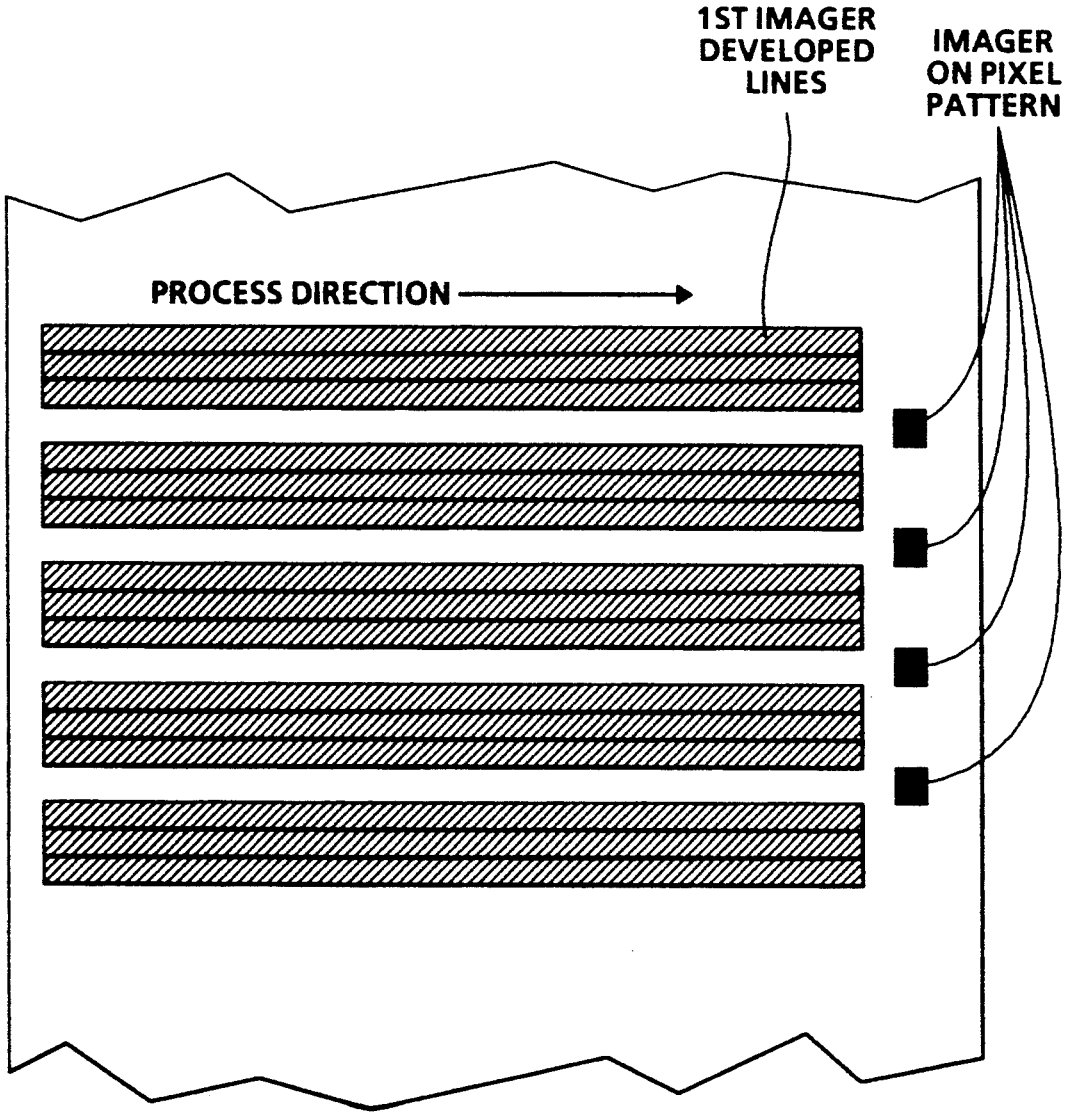
FIG. 2 illustrates a Gaussian array line pattern on the photoconductive belt and the corresponding Gaussian pattern for the image bar.

Misregistration in the lateral direction can be avoided by using a target pattern consisting of a developed array of lines perpendicular to the image bar axis and then illuminating (utilizing an appropriate illumination pattern) this developed line array with the subsequent image bars. Lateral registration is then achieved by scanning the illumination pattern along the axis of the imager and determining the position of the maximum or minimum light signal. The choice of the maximum or minimum depends on the choice of line array pattern and illumination pattern. A large number of choices is possible for the initial line array pattern. For example, the most straight forward pattern would be repeating sequence of on off pixel lines parallel to the process direction (e.g 010101010101010) with the corresponding pixels illuminated at the imager. Such a pattern would enable lateral alignment to a high precision with the highest signal to noise ratio. However, the signal to noise ratio would be poor in determining the lateral registration modulo pixel. Other patterns such as one on three off (e.g. 1000100010001), would reduce the integral lateral position uncertainty but at a slight loss in signal to noise ratio as shown in FIG. 2. An example of a pattern which gives fairly good lateral position dependence with no integral uncertainty is a gaussion like pattern such as 111011010110111.

Figure 3:
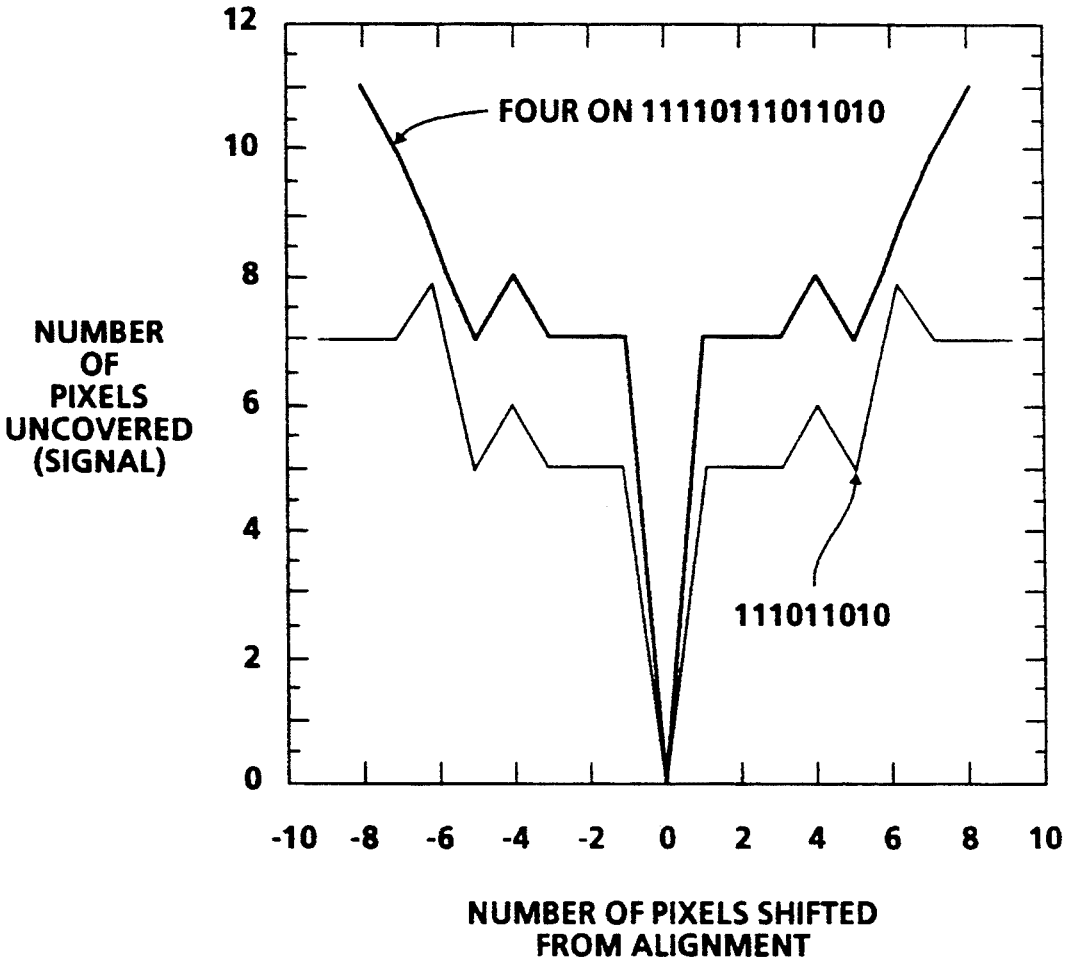
FIG. 3 is a signal representation of a simple pixel pattern to measure lateral registration.

When one of the patterns are developed, a series of lines in the process direction will be generated, as shown in FIG. 2. As this pattern passes beneath a subsequent image bar, which has its pixels illuminated in the same pattern, also shown in FIG. 2, a signal can be detected through the photoconductive surface for the pixels that illuminate the undeveloped spaces between the lines and/or outside the developed area. By mechanically moving the image bar 136 with the stepping motors 138 and 139 for displacements of less than one pixel separation and electronically changing the illumination pattern for integer pixel separation displacements, it is possible to locate the position of the maximum signal thus aligning the image bars. Similarly, by illuminating with the same pattern on the image bar 136, as the developed pattern aligned can be achieved by seeking the minimum signal. FIG. 3 shows an example of the signal resulting from misregistrations of the gaussion pattern. Adding lines to the pattern (starting with 4 and increasing) will increase the signal to noise ratio, but not the signal shape, as shown in FIG. 3. A minimum always occurs when the single illuminated pixel is aligned with the single pixel wide toner line at the center. One could also perform the alignment by shifting the position of the developed image on the photoconductor rather than mechanically shifting 136 image bar. One could also perform an approximate alignment by electrically shifting the pixels on imager 136.

It should be apparent to one skilled in the art that other patterns can also be used to achieve alignment. The final implementation of a pattern will depend on various factors such as detector sensitivity, toner usage, registration requirements and etc.

Skew measurement and adjustment can also be achieved by the disclosed invention. Two or more sensors are utilized in position at the inboard and outboard position of the photoconductive belt 10 width. Two perpendicular timing marks are written and developed on the same "line" by the first imaging station and the arrival of each mark sensed at the following imaging station. Any variation in arrival time between the inboard and outboard marks will be sensed by the subsequent imaging station this will indicate a skew position condition. The skew condition can be corrected mechanically by the stepper motor 139 rotating the outer housing 130 or electronically by changing the arrangement of the pixels in image bar to account for the skew or a utilization of a combination of both methods.

One advantageous feature of the present invention is that no permanent marks are used. This eliminates the need to use a fixed pitch in the belt to accommodate different image sizes. However, it should be apparent to one skilled in the art that the developed target marks could be replaced by permanent physical marks (i.e. holes or marked targets) to register the images on the belt. Even though, the use of permanent marks may decrease the total imageable surface area which may be needed to circumvent unanticipated scratches or other physical defects on the imageable surface of the belt.

After imaging station 40*a* registers the image, the imaging station superimposes a second image on the first image and the subsequent image is developed by developer unit 100*a*. Developer unit 100*a* which is representative of the operation of development stations 100*b* and 100*c*, includes a donor roll 102, electrode wires 104 and a magnetic roll 106. The donor roll 102 can be rotated either in the (with) or (against) direction relative to the motion of belt 10. Electrode wires 104 are located in the development zone defined as the space between photoconductive belt 10 and donor roll 102. The electrode wires 104 include one or more thin Metal, Tungsten or Stainless Steel, or other suitable wires which are lightly positioned against donor roll 102. The distance between wires 104 and donor roll 102 is approximately the thickness of the toner layer on donor roll 102. An electrical bias is applied to the electrode wires by a voltage source. A voltage source electrically biases the electrode wires with both a DC potential and an AC potential. A DC voltage source establishes an electrostatic field between photoconductive belt 10 and donor roll 102. In operation, magnetic roll 106 advances developer material comprising carrier granules and toner particles into a loading zone adjacent donor roll 102. The electrical bias between donor roll 102 and magnetic roll 106 causes the toner particles to be attracted from the carrier granules to donor roll 102. Donor roll 102 advances the toner particles to the development zone. The electrical bias on electrode wires 104 detaches the toner particles on donor roll 102 and forms a toner powder cloud in the development zone. The discharged latent image attracts the detached toner particles to form a toner powder image thereon. The toner particles in developer unit 100*a* are of a color magenta. Belt 10 is recharged by the charging unit 32*b* and advances to the next imaging station 40*b* where the imaging station 40*b* re-registers the photoconductive belt 10 and then superimposes a subsequent image by selectively discharging the recharged photoconductive surface and developer unit 100*b* develops the image with yellow toner. The belt 10 is recharged by charging unit 32*c* and imaging station 40*c* re-registers the photoconductive belt 10 and superimposes a subsequent image by selectively discharging the recharged photoconductive surface and developer unit 100*c* develops the image with cyan toner.

The resultant image, a multi-color image by virtue of the developing station 30, 100*a*, 100*b* and 100*c* having black, yellow, magenta, and cyan, toner disposed therein advances to transfer station D. It should be evident to one skilled in the art that the color of toner at each development station could be in a different arrangement. At transfer station D, a sheet or document is moved into contact with the toner powder image. Next, a corona generating device 41 charges the sheet to the proper magnitude and polarity as the sheet is passed through photoconductive belt 10. The toner powder image is attracted from photoconductive belt 10 to the sheet. After transfer, a corona generator 42 charges the sheet to the opposite plurality to detack the sheet from belt 10. Conveyor 44 advances the sheet to fusing station E.

Fusing station E includes a fuser assembly indicated generally by the reference numeral 46, which permanently affixes the transferred toner powder image to the sheet. Preferably, fuser assembly 46 includes a heated fuser roll 48 and a pressure roll 50 with the powder image on the sheet contacting fuser roll 48. The pressure roll is cammed against the fuser roll to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the sheets are fed through a decurler 52. Decurler 52 bends the sheet in a first direction and puts a known curl in the sheet, and then bends it in the opposite direction to remove that curl.

Forwarding rollers 54 than advance the sheet to duplex turn roll 56. Duplex solenoid gate 58 guides the sheet to the finishing station F or to duplex tray 60. At finishing station F, sheets are stacked in a compiler to form sets of cut sheet. The sheets of each set are optionally stapled to one another. The set of sheets are then delivered to a stacking tray. In a stacking tray, each set of sheets may be offset from an adjacent set of sheets.

With continued reference to the figure, duplex solenoid gate 58 directs the sheet into duplex tray 60. Duplex tray 60 provides an intermediate or buffer storage for those sheets that have been printed on one side on which an image will be subsequently printed on the second, opposed side thereof, i.e. the sheets being duplexed. The sheets are stacked in duplex tray 60 face down on top of one another in the order in which they are being printed.

In order to complete duplex printing, the simplex sheets in tray 60 are fed, in seriatim, by bottom feeder 62 from tray 60 back to transfer station D via a conveyor 64 and rollers 66 for transfer of the toner powder image to the opposed side of the sheet. Inasmuch as successive sheets are fed from duplex tray 60, the proper or clean side of the sheet is positioned in contact with belt 10 at transfer station D so that the toner powder image is transferred thereto. The duplex sheet is then fed through the same path as the simplex sheet to be advanced to finishing station F.

Sheets are fed to transfer station D from secondary tray 68. Secondary tray 68 includes an elevator driven by a bi-directional AC motor. Its controller has the ability to drive the tray up or down. When the tray is in the down position, stacks of sheets are loaded thereon or unload therefrom. In the up position, successive sheets may be fed therefrom by sheet feeder 70. Sheet feeder 70 is a friction retard feeder utilizing a feed belt and take-away rolls to advance successive sheets to transport 64 which advances the sheets to rolls 66 and then to transfer station D.

Sheets may also be fed to transfer station D from the auxiliary tray 72. Auxiliary tray 72 includes an elevator driven by bi-directional AC motor. Its controller has the ability to drive the tray up or down. When the tray is in the down position, stacks of sheets are loaded thereon or unloaded therefrom. In the up position, successive sheets may be fed therefrom by sheet feeder 74. Sheet feeder 74 is a friction retard feeder utilizing a feed belt and take-away rolls to advance successive sheets to transport 64 which advances the sheets to rolls 66 and to transfer station D.

Secondary tray 68 and auxiliary tray 72 are secondary sources of sheets. A high capacity feeder indicated generally by the reference numeral 76, is the primary source of sheets. High capacity feeder 76 includes a tray 78 supported on elevator 80. The elevator is driven by a bi-directional AC motor to move the tray up or down. In the up position, the sheets are advanced from the tray to transfer station D. A fluffer and air knife directs air onto the stack of sheets on tray 78 to separate the uppermost sheet from the stack of sheets. A vacuum pulls the uppermost sheet against the belt 81. Feed belt 81 feeds successive uppermost sheets from the stack to a take-away drive roll 82 and idler rolls 84. The drive rolls and modular rolls guide the sheet onto transport 86. Transport 86 advances the sheet to roll 66 which, in turn, move the sheet to transfer station D.

After the sheet is separated from photoconductive belt 10, some residual toner particles in the image frame remain adhering thereto and the developed target marks. After transfer, photoconductive belt 10 passes beneath corona generating device 94 which charges the residual toner particles to the proper polarity. Thereafter, the pre-charged array lamp (not shown), located inside photoconductive belt 10 discharges the photoconductive belt in preparation for the next imaging cycle. Residual particles and target marks are removed from the photoconductive surface at cleaning station G.

Cleaning station G includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper, debris and wrong sign toner particles. The toner particles on the reclaim roll are scrapped off and deposited in a reclaim auger (not shown), where it is transported out of the rear of the cleaning station G.

In recapitulation, positional tracking is achieved in a moving photoconductive belt to permit superposing registered latent images. An imager is used as the light source. Process direction, lateral registration and skew errors are sensed by developing an appropriate set of target marks with the first imager and first developer unit, by placing appropriate sensor elements behind the photoconductive belt at the second (and subsequent) imagers, and by examining the light output from each imager as the set of developed target marks pass between the imager and the sensor. Once imager alignment and registration errors are detected, the error signals control adjustment of the imager positions to correct the alignment errors. When aligning multiple imagers, only the first development unit is required to be functional within the machine. The intensity variation in imager output is also sensed.

While the apparatus and method for positional tracking a moving photoconductive belt is shown in a single pass color electrophotographic printing machine, it should be understood that the invention could be used in a multiple pass color printing machine as well.

It is, therefore, apparent that there has been provided in accordance with the present invention, an apparatus and method for positional tracking a moving photoconductive belt that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A printing device having an imageable surface adapted to move along a preselected path, wherein the improvement includes:

a first image processing station adapted to record a first latent image and a target latent image on the imageable surface;

means for developing at least the target latent image on the imageable surface to form a developed target image;

a second image processing station adapted to record a second latent image on the imageable surface, said second image processing station illuminating the developed target image to form an illuminated image;

means for sensing an intensity of the illuminated image to indicate deviations of the imageable surface from the preselected path; and means, responsive to said sensing means, for adjusting said image processing station to compensate for deviations of the imageable surface from the preselected path.

2. The printing device of claim 1, further comprising control means, responsive to said sensing means, for transmitting signals to said adjusting means.

3. The printing device of claim 1, further comprising:

means for translating said image processing station to compensate for detected deviations by said sensing means;

means for rotating said image processing station to compensate for detected registration deviations; and control means, responsive to said sensing means, for transmitting actuating signals to said translating means and said rotating means.

4. The printing device of claim 1, wherein said second image processing station includes an image bar for recording said second latent image on the imageable surface.

5. The printing device of claim 4, wherein the developed target image on the imageable surface forms a line array pattern.

6. The printing device of claim 5, wherein said image bar illuminates a pixel pattern on the line array pattern formed on the imageable surface.

7. The printing device of claim 6, wherein the line array pattern is formed along a process direction on the imageable surface and is substantially perpendicular to said image bar, thereby, when said image bar illuminates said line array pattern on the imageable surface, said sensing means senses light transmitted through the imageable surface and generates a signal indicative of registration of said first image on the imageable surface.

* * * * *